US005685743A

United States Patent [19]

Schmidt et al.

[11] Patent Number: 5,685,743

[45] Date of Patent: Nov. 11, 1997

[54] CONNECTOR HOUSING FOR AN AIR BAG CONNECTOR AND A METHOD FOR CONTACTING A CONNECTOR HOUSING

[75] Inventors: Karsten Schmidt, Radevormwald; Werner Moritz, Wuppertal; Reinhard Pusch, Stemwede, all of Germany

[73] Assignee: Grote & Hartmann GmbH & Co. KG, Wuppertal, Germany

[21] Appl. No.: 554,050

[22] Filed: Nov. 6, 1995

[30] Foreign Application Priority Data

Nov. 7, 1994 [DE] Germany ..... 44 39 786.0
Sep. 26, 1995 [DE] Germany ..... 195 35 836.8

[51] Int. Cl.[6] ..... H01R 13/502

[52] U.S. Cl. ..... 439/701; 439/417; 439/594

[58] Field of Search ..... 439/405, 406, 439/404, 937, 717, 417, 590, 594

[56] References Cited

U.S. PATENT DOCUMENTS

| | | | |
|---|---|---|---|
| 3,985,416 | 10/1976 | Dola et al. | 439/405 |
| 4,169,647 | 10/1979 | Knowles et al. | 439/405 |
| 4,767,353 | 8/1988 | Hughes et al. | 439/937 |
| 5,332,330 | 7/1994 | Kaneko . | |

FOREIGN PATENT DOCUMENTS

| | | |
|---|---|---|
| 93116173 | 4/1994 | European Pat. Off. . |
| 95400416 | 9/1995 | European Pat. Off. . |
| 2356828 | 1/1978 | France . |
| 2691216 | 11/1993 | France . |
| 2638463 | 3/1978 | Germany . |
| 2937468 | 1/1980 | Germany . |
| 3111073 | 2/1982 | Germany . |
| 3541610 | 5/1987 | Germany . |
| 3734654 | 4/1989 | Germany . |
| 4113380 | 10/1991 | Germany . |
| 4114057 | 11/1992 | Germany . |
| 4140692 | 6/1993 | Germany . |
| 4330075 | 4/1994 | Germany . |
| 4403181 | 9/1994 | Germany . |
| 9411763 U | 11/1994 | Germany . |
| 4327381 | 2/1995 | Germany . |

*Primary Examiner*—Gary F. Paumen
*Assistant Examiner*—Christopher Goins
*Attorney, Agent, or Firm*—Jones & Askew

[57] ABSTRACT

A connector housing for an air bag connector and a method for contacting an air bag connector. A connector housing having at least two sections is provided with locking elements for a pre-lock-in position and a final lock-in position. In the pre-lock-in position, both sections of the housing are arranged apart from one another and the pre-lock-in position is localized by means of a spacer to maintain the pre-lock-in position maintain at a predetermined distance so that electric conductors can be introduced into the connector housing. The spacer ensures that the connector housing is not inadvertently pressed from the pre-lock-in position to the final lock-in position. The connector housing can be pressed together for an insulation-piercing contact in the connector housing, and locked in the final lock-in position. The connector housing is furthermore provided with a belt arrangement, with the spacer being of a one-piece design with one of the elements of the belt arrangement. When the connector housing is pressed together to engage the line with the contacts, the belt arrangements are cut away so that the spacer is also removed with the belt arrangements.

24 Claims, 9 Drawing Sheets

Figure 1:
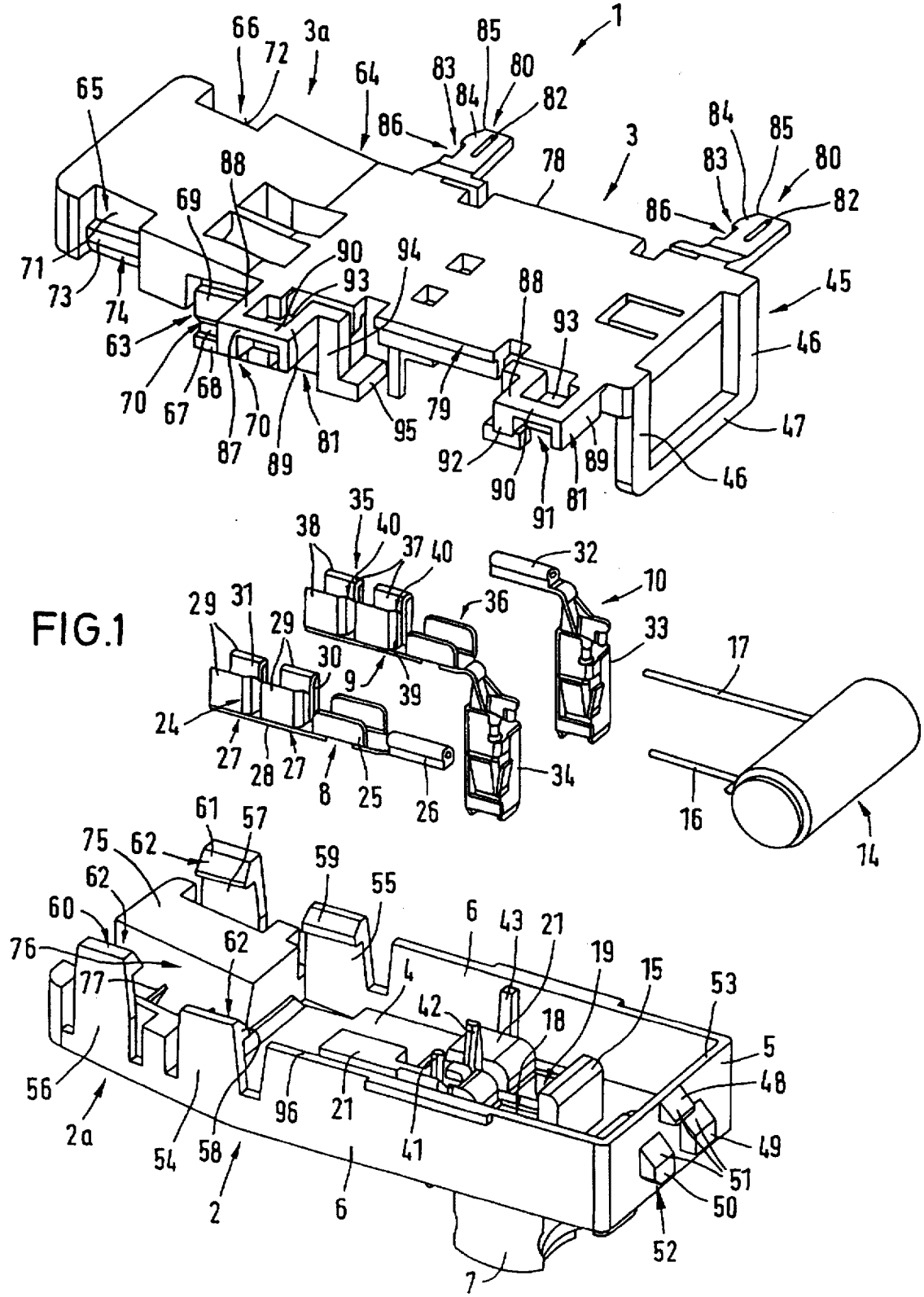

CONNECTOR HOUSING FOR AN AIR BAG CONNECTOR AND A METHOD FOR CONTACTING A CONNECTOR HOUSING

The invention pertains to a connector housing for an air bag connector and a method for contacting an air bag connector.

An air bag is a safety arrangement for a motor vehicle, composed of an air bag which, by means of a gas generator, is inflated in fractions of a second to thus be able to protect vehicle passengers from severe injury in an accident.

The gas generator contains a small bursting charge which is activated by a primer. In the manufacture of a motor vehicle, an air bag module comprising the air bag, gas generator and primer is installed in the motor vehicle as a prefabricated part and contacted electrically by means of an air bag connector.

Known connector housings for air bag connectors are of a two-part design with a roughly cuboid base and a cover which can be plugged together with and locked to the base. A cylindrical tower extends downward from the lower surface of the base. Two jacks are provided in the tower, each to accept one connector pin of the primer, so that the prefabricated air bag module can be contacted to ignition lines by means of a simple plug-in process. The shape of the air bag connector is standardized and is the same for all motor vehicle manufacturers.

The air bag connector also accommodates a coil which is switched in series with the primer. Therefore, three contacts are provided in the air bag connector: the first contact which connects a first ignition line to a terminal connection of the coil; the second contact which connects an additional terminal of the coil to the first connector pin of the primer; and the third contact which connects a second connector pin to a second ignition line.

Contacting of the first and third contacts is executed by the vehicle manufacturer and conventionally occurs by means of soldering or crimping. For this, the individual contacts are put in the base of the air bag connector, the first and third contact soldered or crimped to ignition lines and, after that, the cover placed on and locked to the base.

These steps represent a considerable expenditure of time in the installation of an air bag module and therefore generate considerable cost.

A connector housing is known from DE 3,734,265 C2, in which insulation-piercing contacts are provided for the contacting of lines. This connector housing is composed of a cover and main housing. The cover is seated on and can be locked to the main housing, where a preassembly position (pre-lock-in position) and a final position (final lock-in position) of the cover are provided. In the preassembly position, conductor strands can be plugged without intereference into corresponding holes for the strands in the cover. When the cover is pressed down into the final lock-in position, a cutting into of the conductor strand occurs by means of vertically arranged engagement terminals. The penetration terminals are components of electric contacts, so that an insulation-piercing contact between the conductor strands and the corresponding contacts is produced by means of a pressing down of the cover.

This type of insulation-piercing contact with a pre-locking and final lock-in position permits a quick and secure contacting of electrical conductors to the corresponding contacts.

DE 3,541,6190 A1 describes a belt arrangement with which plastic housings can be connected to form a flexible housing belt. The housings are executed so that they can be plugged together and feature, for this purpose, an injection-molded material stay which stands off, e.g., from an upper surface and a recess for the material stay, e.g., on the opposing lower surface.

Several such housings plugged together to form a housing belt form a flexible belt which can be rolled up and processed by machine.

This belt arrangement requires little material for connecting the housings and the housings can be separated from one another in a relatively simple manner. In addition, connector housings with locking arrangements are known, which are used to lock the plug-in connection of the connector housing to a counter-connector housing. These type of locking arrangements generally feature, on one of the connector housings, a locking element which operates against a flexible restoring force, e.g., a horizontally swinging lever arm or bridge, which, having a locking projection or locking recess operates in connection with a corresponding, yet rigid, or nonmovable locking recess or locking projection of the other section to be locked in. In this connection, the lever arm or bridge can be of a single-armed or double-armed design. Locking arrangements, which can be disengaged or unlocked feature for disengaging the locking piece, an actuating arrangement or actuating element for horizontally swinging the lever arm, or the locking elements are designed such that they are disengaged or unlocked with the action of a certain force, e.g., a tensile force.

Known locking arrangements, after being locked, are designed either to be easily disengaged or are executed in such a way that they remain locked in a manner preventing disengagement and cannot be taken apart from one another without destruction of the locking elements. An uncontrolled disengagement, in particular for an air bag connector, can lead to an undesirable unwanted function or a nonfunction of the air bag, such that the safety function of the air bag is not ensured.

In principle, it is applicable in the case of connector housings for air bag connectors that they are subject to high safety standards as they form the electric and mechanical connection to the primer which activates the air bag. A failed contact at the air bag connector owing to a failure in the manufacturing or contacting process or by means of a disengagement of the contact owing to vibrations occurring in the vehicle leads to an unwanted function or nonfunction of the air bag, so that the safety function of the air bag is not ensured with a defective air bag connector or defective plug-in connection.

In the meantime, air bags are being built into almost all motor vehicles, such that connector housings for air bag connectors constitute a mass-produced product and must therefore also permit, apart from high safety standards, a simple contacting and ease of manufacture, where their production is to require little material.

The purpose of the invention is to create a connector housing, suitable for an air bag connector, which will fulfill the high safety standards for an air bag connector, is simple to contact and to manufacture, is of simple design and, in particular, the manufacture of which requires little material.

The at least two-part connector housing according to the present invention is provided with locking elements for a pre-lock-in position and a final lock-in position, where in the pre-lock-in position, both sections of the housing are arranged apart from one another and the pre-lock-in position is localized by means of a spacer. This ensures that the pre-lock-in position is maintained at a predetermined distance so that one or more electric conductors can be introduced into the connector housing, where the connector housing can be pressed together, in order for an insulation-piercing contact to be developed with a contact located in the connector housing, and locked in the final lock-in position. The connector housing is furthermore provided with a belt arrangement, with the spacer being of a one-piece design with one of the elements of the belt arrangement.

The spacer ensures that the connector housing is not inadvertently pressed from the pre-lock-in position to the final lock-in position. When the connector housing is pressed together in order for the line to be contacted with the contacts, the belt arrangements are cut away so that the spacer is also removed with the belt arrangements. The contacting process therefore requires only two steps, namely, introduction of the electric line and the combined pressing together of the connector housing and cutting away of the belt arrangements. This can occur in a fully automatic manner at a high processing speed, as the connector housing according to the invention is protected by the spacer from an unwanted connection.

The connector housing further features a locking arrangement with movable locking element. The locking arrangement is provided with a blocking arrangement with a safety bolt, which in the blocking position blocks movement of the movable locking element. The catch can be shifted between the blocking position and a preblocking position to enable the prevention of both an uncontrollable disengagement as well as a loosening of the locking arrangement.

With the locking arrangement which can be latched according to the invention, a plug-in connection of the connector housing for an air bag connector is locked to an air bag module, where the plug-in connection between the connector housing for the air bag connector and the air bag module is secured against an unwanted disengagement, by which means the functional safety of an air bag joined thereto is increased in a simple manner.

Figure 2:
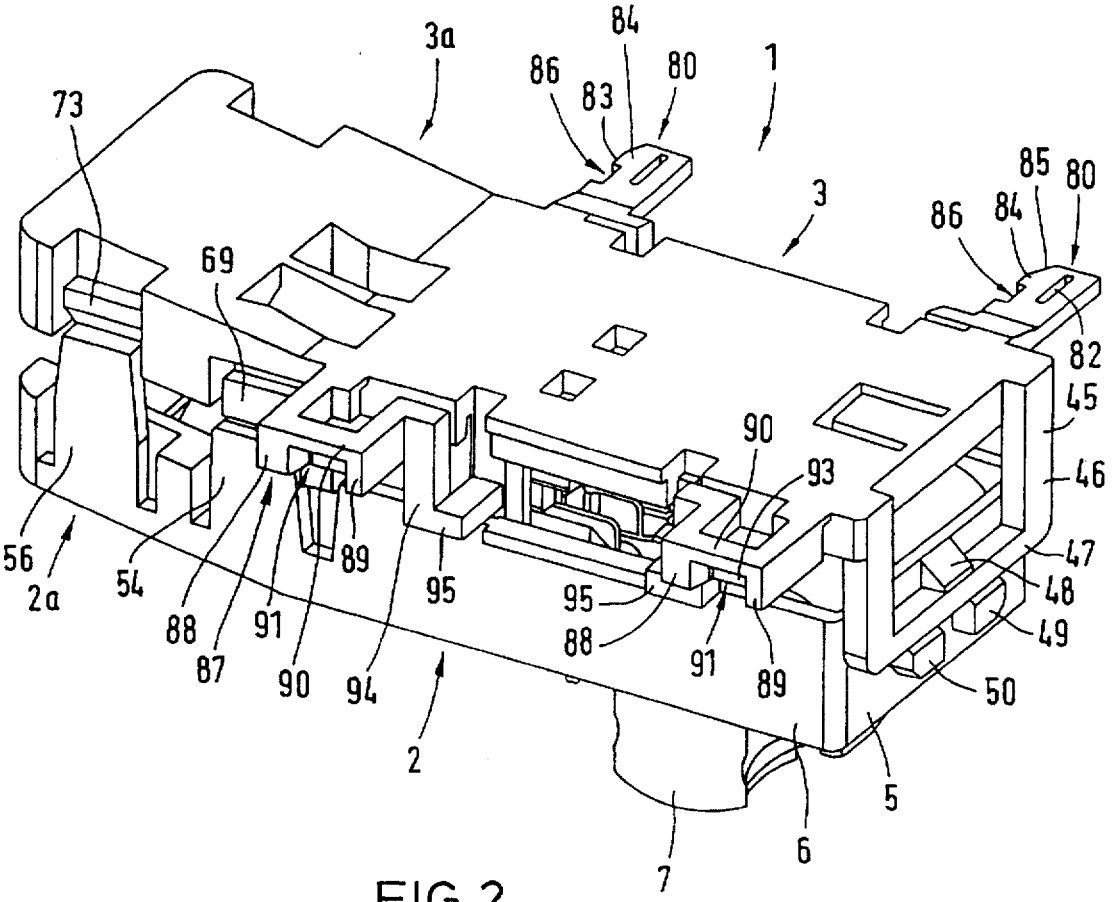
Figure 3:
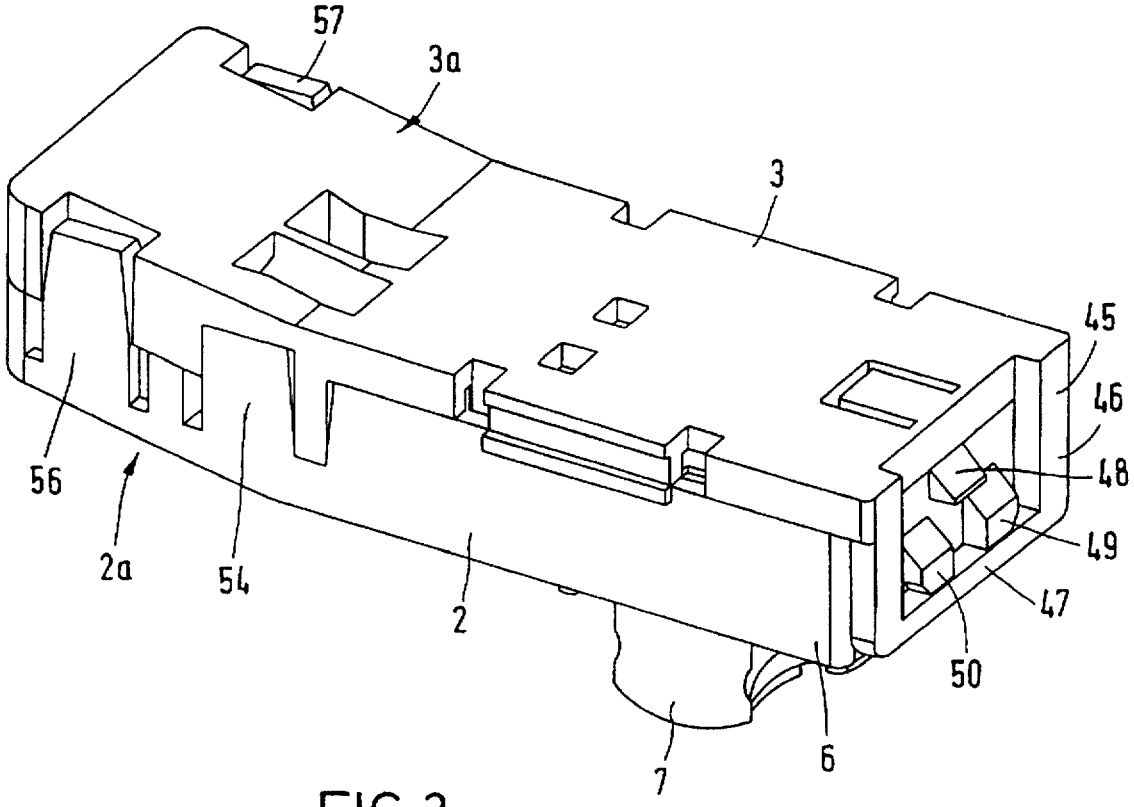
Figure 8:
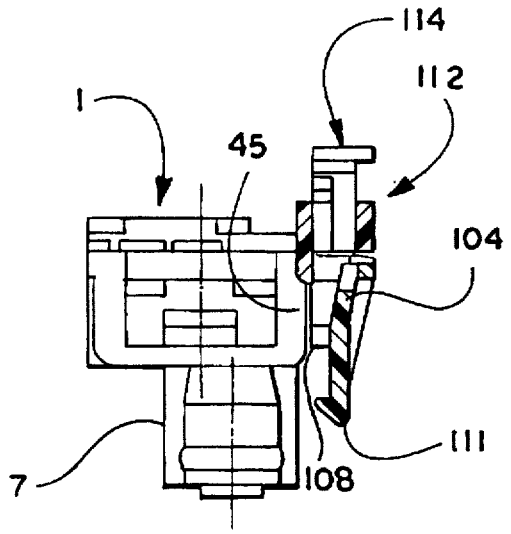
Figure 9:
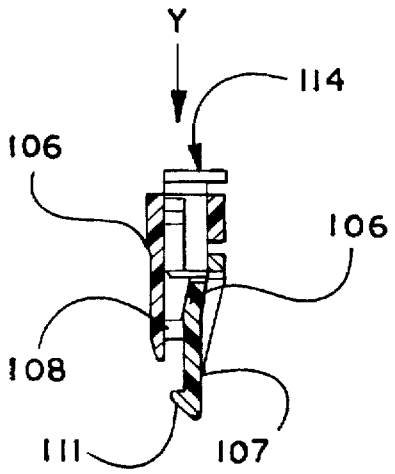
Figure 11:
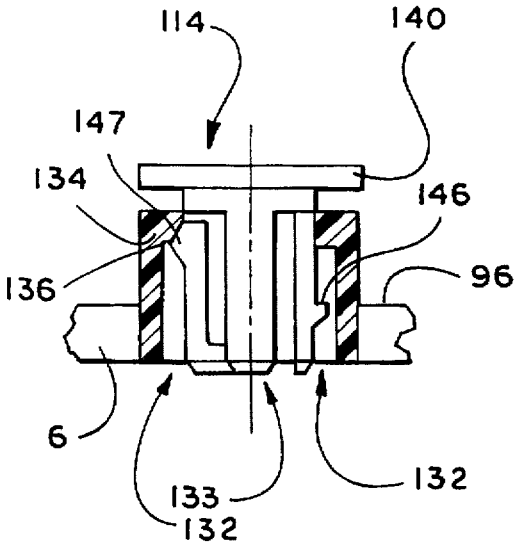
Figure 10:
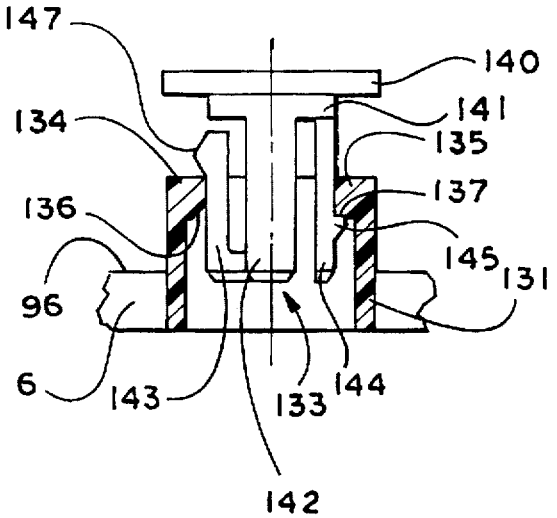
Figure 12:
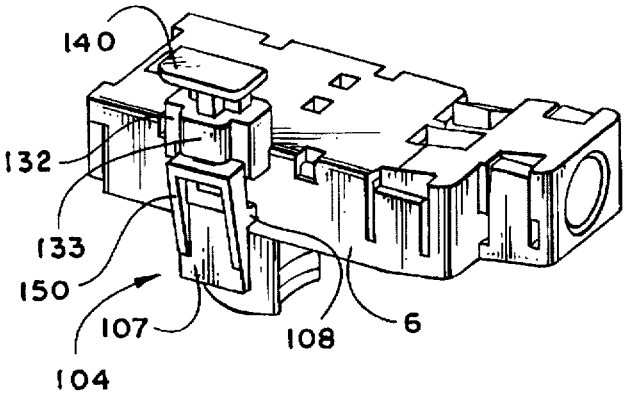
Figure 13:
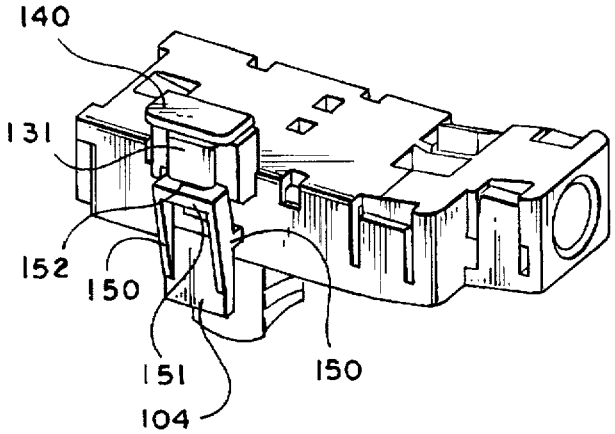
Figure 14:
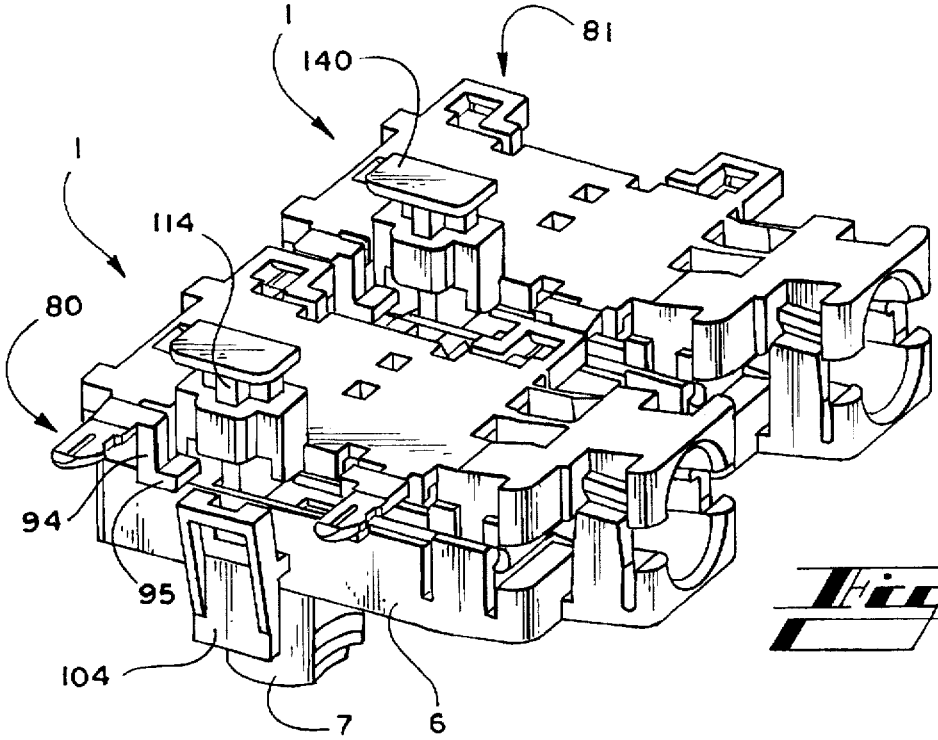

The invention is more closely explained in the following with the aid of drawings. The drawings shows schematically in:

FIG. 1: One embodiment of a connector housing with belt arrangement, in exploded view, FIG. 2: The connector housing shown in FIG. 1, in perspective view, in a pre-lock-in position, FIG. 3: The connector housing shown in FIG. 1, in perspective view, in a final lock-in position, FIG. 4: A top view of the connector housing shown in FIG. 1, without cover, FIG. 5: In cross section, a region of a connector during introduction of contacting connector pins of a primer, FIG. 6: In cross section, the region of the connector from FIG. 5, with contacting connector pins introduced, FIG. 7: A simplified representation of a locking arrangement according to the invention, FIG. 8: A longitudinal section through the narrow side of a locking arrangement of a connector housing with a safety bolt in a preblocking position, FIG. 9: A section according to FIG. 8, with the safety bolt in a blocking position, FIG. 10: A longitudinal section through the broad side of the blocking arrangement shown in FIG. 4, with the catch in the preblocking position, FIG. 11: A section according to FIG. 10, with the catch in the blocking position, FIGS. 12,13: One perspective view of a connector housing for an air bag connector with the locking arrangement which can be latched according to the invention in the preblocking and blocking position respectively, FIG. 14: A perspective view of a connector housing for air bag connectors which are connected to one another by means of the belt arrangement.

FIGS. 1–4 represent a first embodiment of a connector housing according to the invention for an air bag connector.

The connector housing (1) is composed of two housing sections, a roughly cuboid base (2) and a cover (3). The base (2) has a base wall (4), two side walls (6) and, at the front, an end wall (5). At the base (2), a connector tower (7) extends downward from the base wall (4).

Three contacts (8,9,10) are carried in the connector housing (1) in order to connect two ignition lines (not represented) to a primer (13) and coil. The coil (14) is arranged in the front end region of the air bag connector (1), immediately behind the end wall (5), and localized by means of a coil stay (15) running transverse to the center of the base wall (4) and parallel to the end wall (5). The coil stay (15) is adjacent to only the center region of the coil (14) so that two jumping wires serving as coil terminal connections (16,17) can be guided past the coil stay (15) toward the back of the connector housing (1).

Two contact cavities (18,19) leading downward through the connector tower (7) are arranged in the region behind the coil stay (15), in order to accept the contacts (9,10). An air bag module (20) can be plugged onto the connector tower (7) so that the primer (13) located in the air bag module (20) can be connected by two connector pins (22,23), by means of the contacts (9,10), to two ignition lines (not represented).

The first contact (8) connects one of the ignition lines to one of the coil terminal connections (16), the second contact (9) connects the other coil terminal connection (17) to one of the connector pins (23) of the primer (21) and the third contact (10) connects the other connector pin (22) to the additional ignition line. The primer (21) and coil (14) are therefore connected in series in the ignition lines.

The first contact (8) is of a linear design with an insulation-piercing contact region (24), a base (25), U-shaped in cross section, and a crimping region (26). The insulation-piercing contact region (24) is composed of two U-shaped sections (27) with continuous base wall (28), each having two parallel opposing side walls (29). Connected to the side walls (29), in the direction of the base (25), are tabs (30) each bent inward which, between one another, border one insulation-piercing gap (31) respectively, in which a jumping wire of an ignition line can be pressed in a manner in which it is pierced so that an electrical connection occurs between the contact (8) and jumping wire. The coil terminal connection (16) is contacted to the contact (8) at the crimping region (26).

The second contact (10) is of an angular design, with a crimping region (32) forming one leg of the angle and, forming the other leg, a box-type plug-in jack (33) which is carried in the contact cavity (19) and serves to accept, in an electrically contacting manner, the connector pin (23) of the primer (21). The coil terminal connection (17) is contacted to the contact (10) at the crimping region (32).

The third contact (9) is also of an angular design, where the legs of the angle are formed by a box-type plug-in jack (32) and an insulation-piercing contact region (35) which features, in the same way as the insulation-piercing contact region (24) of the first contact (8), a U-shaped base (36), two U-shaped sections (37) with side walls (38) and inward bent tabs (39) which each border an insulation-piercing gap (40).

Figure 4:
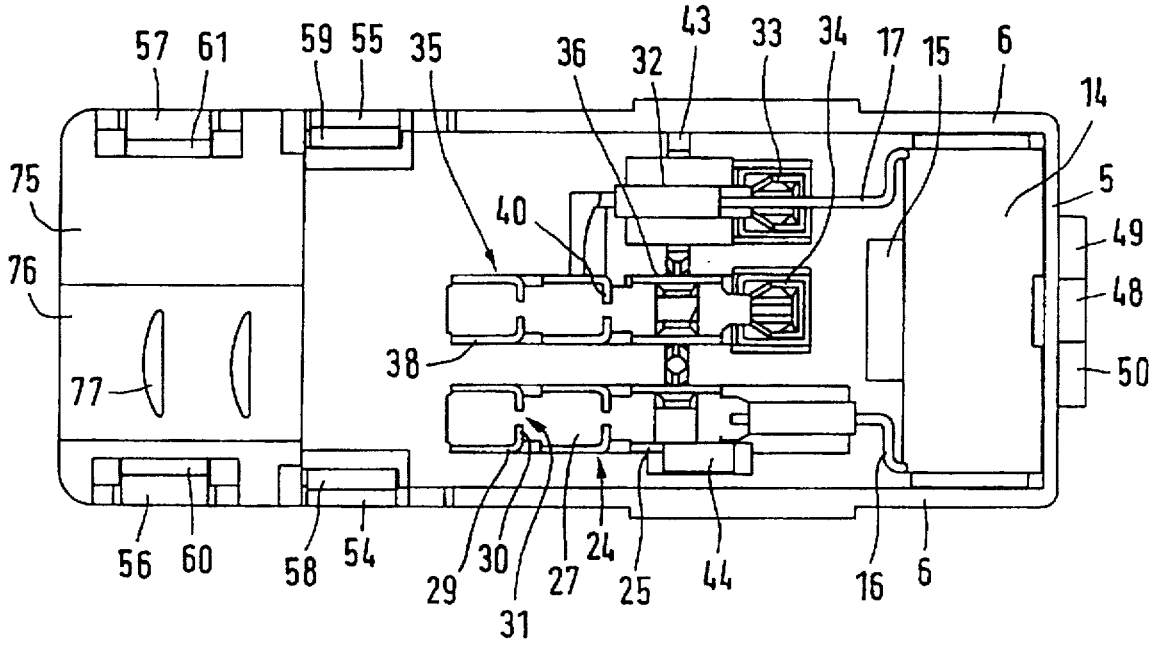

The contacts (8,9,10) are carried lying on the base wall (4) of the base (2) next to one another in the longitudinal direction of the connector housing (1), where they are raised by means of platforms (21) and kept at a distance from one another by means of two spacer pins (41,42) standing off from the base wall (4) in a perpendicular manner. To the side, their position is bordered by an additional spacer pin (43) or guide stay (44) which supports the first contact (8) (FIG. 4). The box-type plug-in jacks (33,34) of the contacts (9,10) are carried in the contact cavities (18,19) of the connector tower (7) so that only the crimping region (32) or insulation-piercing contact region (35) is supported by the platform (21) of the base wall (4).

The front face of the cover (3) has a locking spring clip (45) with two lateral stays (46) running downward and a transverse stay (47) connecting these at the lower ends of the stays (46). The locking spring clip (45) works in connection with three locking lugs (48,49,50) arranged on the outside of the end wall (5). The locking lugs (48,49,50) each have an approach bevel (51) starting from the top and running out and forward, and a lower locking surface (52) perpendicular to the end wall (5). The locking lug (48) is arranged immediately below the upper transverse edge (53) of the end wall (5) and at the transverse center of the end wall (5). The two other locking lugs (49,50) are arranged at the same height, somewhat underneath the locking lug (48), and laterally displaced with respect to the transverse center of the end wall (5).

The back regions (2*a*,3*a*) of the base (2) or cover (3) respectively are each bent somewhat upward and are equipped with additional locking arrangements. Thus, in this back region (2*a*) of the base (2), two locking spring arms (54,55;56,57), which extend across almost the entire height of the side walls (6), are cut out from their respective side walls (6) of the base (2). The upper end of each locking spring arm (54,55;56,57) has an inward-facing locking lug (58,59,60,61), each of which has an approach bevel (62) running from the top downward in the direction of the longitudinal center of the air bag connector. The cover has recesses (63,64;65,66) corresponding to each of the locking spring arms (54,55;56,57), where the two front recesses (63,64) are each carried at the bottom by means of a stay (67) so that there is sufficient space in the recesses (63,64) for two locking lugs (68,69) corresponding to the locking spring arms (54,55). The locking lugs (68,69) are arranged one above the other and are provided with approach bevels (70) that start at the bottom and run outward and upward.

The back recesses (65,66) each feature only one locking lug (73) which also has an approach bevel (74) that starts at the bottom and runs outward and upward.

One strong material stay (75) respectively extends between the rear locking spring arms (56,57) at the back region (2*a*) of the base (2) or between the rear recesses (71,72) at the rear region (3*a*) of the cover (3). The material stays (75) occlude the connector housing (1) from the rear in the plugged-together state. In the region behind the contacts (8,9), the material stays (75) each feature an arched material hollow (76) with two short transverse ribs (77), where, when the connector housing (1) is closed, the material hollows (76) serve as a leadthrough for the ignition lines and, with the transverse ribs (77), provide for strain relief at the ignition lines.

The connector housing (1), with coil (14) put in place and contacts (8,9,10) put in place and contacted to the coil terminal connections (15,16), is supplied to the motor vehicle manufacturer in a pre-lock-in position (FIG. 2) by the manufacturer of the air bag connector. In the pre-lock-in position, the transverse stay (47) of the locking spring clip (45) grips behind the upper locking lug (48) on the end wall and the two front locking spring arms (54,55) grip behind the lower locking lugs (68) in the front recesses (63,64). In this pre-lock-in position, the cover (3) is separated from the base (2) in such a way that the ignition lines can be introduced through the open passages at the back region (2*a*,3*a*) in the connector housing (1), such that their ends lie over the insulation-piercing contact regions (24,35).

By means of a subsequent pressing together of the connector housing (1) to a final lock-in position, the cover (3) presses the ignition lines into the insulation-piercing gap (31,40) so that an insulation-piercing electric connection is produced between the ignition lines and contacts (8,10). In the final lock-in position, the transverse stay (47) of the locking spring clip (45) grips behind the two lower locking lugs (49,50) on the end wall (5) and the locking spring arms (54,55;56,57) grip behind the upper locking spring lugs (73) in the rear recesses (65,66), so that the cover (3) is rigidly localized on the base (2). The transverse ribs (77), lying against the ignition lines from above and below, localize the ignition lines in a longitudinal direction so that the insulation-piercing contact regions (24,35) are relieved of strain.

A contacting of the connector housing according to the invention therefore comprises only the two steps of introducing the ignition lines and pressing together the air bag connector from the pre-lock-in position to the final lock-in position.

The connector housing (1) is provided with belt arrangements so that several connector housings can be plugged together to form a flexible band and processed at a high speed as narrow goods wound onto spools.

As belt arrangements, the cover (3) features belt-locking stays (80) standing off in a perpendicular manner from the longitudinal lateral edges (78,79) or corresponding belt-locking cavities (81). Two belt-locking stays (80) are arranged on one of the longitudinal lateral edges (78) of the cover, such that they can be plugged together with two belt-locking cavities (81), diametrically opposed on the same cover (3), arranged on another cover (3).

The belt-locking stay (80) has a shape which is rectangular in some respects, with a stretched elongated hole (82), which bestows a transverse resiliency to the belt-locking stay (80), running transverse to the longitudinal lateral edge (78) of the cover (3). The outside of the belt-locking stay (80), at the rear longitudinal lateral edge (83) running parallel to the elongated hole (82), has a locking lug (84) with approach bevel (85) which, from the outer edge (86) of the belt-locking stay (80) running transverse to the elongated hole, runs diagonally inward and to the rear. The locking lug (84) is undercut by a recess (86).

The belt-locking cavities (81) are formed from a body (87), U-shaped in top view, with two lateral legs (88,89) which stand off in a perpendicular manner from the longitudinal lateral edge (79) of the cover (3) and the outer ends of which are connected to one another by means of a connecting stay (90). The connecting stay (90) is provided with a recess (91), open to the bottom, for the acceptance of the belt-locking stay (80), where the recess (91) at the connecting stay (90) is displaced somewhat toward the front in the direction of the end wall (5) of the connector housing (1), such that a locking projection (92) is formed at the connecting stay (90) bordering the rear legs (88); when the belt-locking stay (80) is plugged into the belt-locking cavity (81), the locking projection (92) is gripped by the recess (86) of the belt-locking stay (80) and the belt-locking stay (80) is secured against slipping out of the belt-locking cavity (81). To the bottom, the belt-locking cavity (81) is occluded by a thin plate (93) which, below, extends between the side legs (88,89). To the top, a belt-locking stay (80) plugged into the belt-locking cavity (81) is bordered only by the narrow connecting stay (90), so that the belt-locking cavity is open at the top in the region next to the longitudinal lateral edge (79) of the cover (3) and an inserted belt-locking stay (80) can freely swing out toward the top. The connection by means of the belt arrangements is limber for this reason and enables a longer belt band composed of several connector housings to be rolled up.

The U-shaped body (87) is connected to the cover (3) by only one of the two side legs (88,89). In the embodiment represented in the figures, the front leg (89) of the front U-shaped body and the rear leg (88) of the rear body are connected to the cover (3). One narrow gap respectively is located between the other side leg (88 or 89) and the longitudinal side edge (79) of the cover (3), so that this open leg (88 or 89) is designed to be springy in a flexible manner. Connected to each open leg (88,89) is one spacer stay (94) respectively, which runs downward in a perpendicular manner and on the lower end of which is provided a spacer foot (95), which extends from the spacer stay (94) in the direction of the longitudinal center of the connector housing (1), so that in the pre-lock-in position it stands on the upper edge (96) of one of the side walls (6) of the base (2).

The spacer composed of the spacer stay (94) and spacer foot (95) ensures that the connector housing (1) is not inadvertently pressed from the pre-lock-in position to the final lock-in position. When the connector housing (1) is pressed together in order to be contacted with ignition lines, the belt-locking stays (80) and belt-locking cavities (81) are cut away, so that the spacers are also removed with the belt-locking cavities (81). Cutting away of the belt arrangements occurs by means of one cut respectively along the longitudinal side edges (78,79) of the cover (3) simultaneously with the pressing together of the connector housing (1). The contacting process therefore again only requires two steps, namely, an introduction of the ignition lines and the pressing together of the connector housing (1) combined with the cutting away of the belt arrangements. This can occur fully automatically at a high processing speed, as the connector housing (1) according to the invention is protected by the spacer from an unwanted plugging-in. In installing an air bag connector with connector housing according to the invention, this signifies a considerable savings of time and cost in comparison to known air bag connectors.

When an air bag module (20) (FIGS. 5,6) is plugged in, an air bag module housing (97) is pushed onto the connector tower (7), where the connector pins (22,23) of the primer (13) are pushed into the plug-in jacks (33,34) (not represented in FIGS. 5,6) carried in the contact cavities (18,19). When the connector pins (22,23) are pushed into the plug-in jacks (33,34), the plug-in jacks disconnect, in a known manner, a short circuiting link (98); this is to prevent an unwanted triggering of the primer (13).

For a further embodiment of the invention, the connector housing (1) for an air bag connector features a locking arrangement (101), in order to lock the plug-in connection to the air bag module housing (97). The air bag module housing (97) therefore represents a counter-connector housing (103) to the connector housing (1), where the connector housing (1) and counter-connector housing (103) can be plugged together in a lockable manner.

Figure 7:
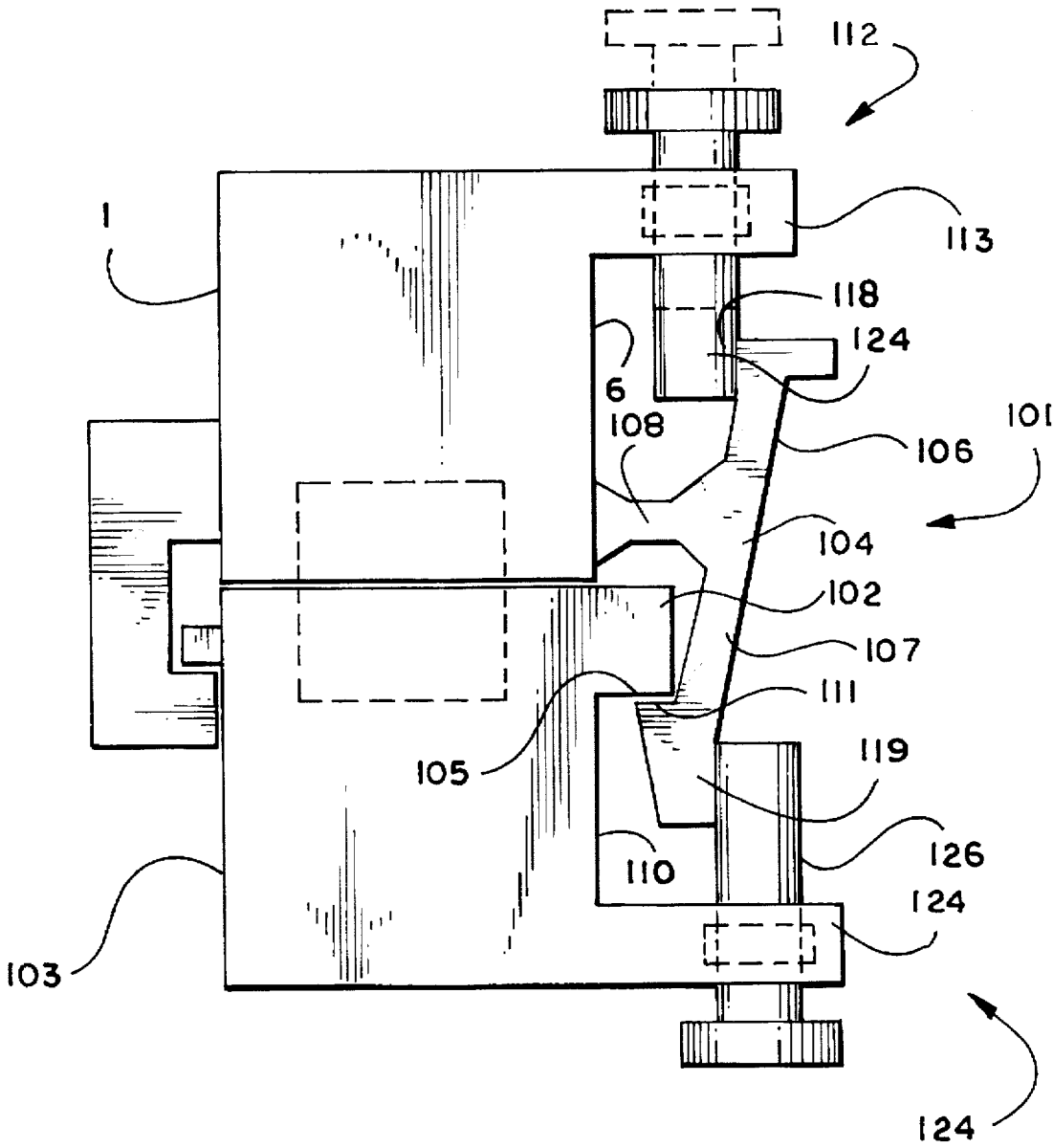

The locking arrangement (101) features, as a movable locking element, a double-armed notch lever arm (104) arranged on the connector housing (1) and, projecting from a side wall (110) of the counter-connector housing (103), a locking stay (102), which forms a recoiling locking edge (105). A lever arm carrier stay (108) of the notch lever arm (104), arranged approximately at the longitudinal center of the latter and standing off at approximately a right angle, is molded to the housing wall or side wall (6) of the connector housing (1). The single-piece notch lever arm (104) features an engagement arm (107) extending from the lever arm carrier stay (108) in the direction of the locking edge (105) and an actuating arm (106) extending in the opposite direction. Molded to the open end of the engagement arm (107) and projecting in the direction of the locking edge (105) is a locking lug (111) which, as FIG. 7 shows, grips behind the locking edge (105), in a known manner, in the lock-in position.

The notch lever arm (104) can be swung around a horizontal axis located in the lever arm stay (108), against a flexible restoring force of the lever arm stay (108), by a pressing of the actuating arm (106) in the direction of the connector housing (1). Here, the locking lug (111) is drawn from the region of the locking edge (105) so that the housings (1,103) can be drawn apart from one another. The connector housing (1) features only a single notch lever arm (104) in order to generate a locking plug-in connection with the counter-connector housing (103). Of course, several of this type of notch lever arms or equally acting locking elements can be provided. The invention is not limited to locking arrangements with notch lever arms; it can also be applied to other spring-loaded projection-forming locking elements, pins, sliders or balls or other such locking arrangements.

A blocking arrangement (112;124) is provided on the locking arrangement (101) in order to block the lock-in position in which the locking lug (111) grips behind the locking edge (105). Two embodiments of blocking arrangements (112;124) are shown in FIG. 7.

The blocking arrangement (112;124) features, molded into the housing (1;103), a guiding arrangement (113;125) in which a safety belt (114;126) is carried in a guided manner such that it can be shifted between a preblocking position and a blocking position. The safety bolts (124;126) are represented by dashed lines in FIG. 7 in the preblocking position and are converted from the preblocking position to the blocking position by being shifted in the direction of the arrow (Y) [sic].

In the blocking position, the safety bolt (114;126) occupies a space of movement (118;119) of the notch lever arm (104) bordering the notch lever arm (104), so that the notch lever arm (104) is barred in the lock-in position. The space of movement (118;119) is the space in the immediate vicinity of the notch lever arm (104) through which the notch lever arm (104) travels for a movement in or out of the lock-in position. The space of movement (118;119) is therefore formed by the gap between the housing wall (6) and actuating arm (106) or is arranged on the side of the engagement arm (107) lying opposite the locking lug (111).

In the blocking position, the safety bolt (114;126) preferably comes into contact with the notch lever arm (104) where it is supported by the largest possible surface of the notch lever arm (104).

In the preblocking position, the safety bolt (114;126) is located outside the space of movement (118;119), so that the lever arm can be actuated in order to be locked or unlocked.

The safety bolt (114;126) can preferably be locked in the blocking position and in the preblocking position, so that the respective position is maintained by the safety bolt (114;126) in a defined manner.

Figure 5:
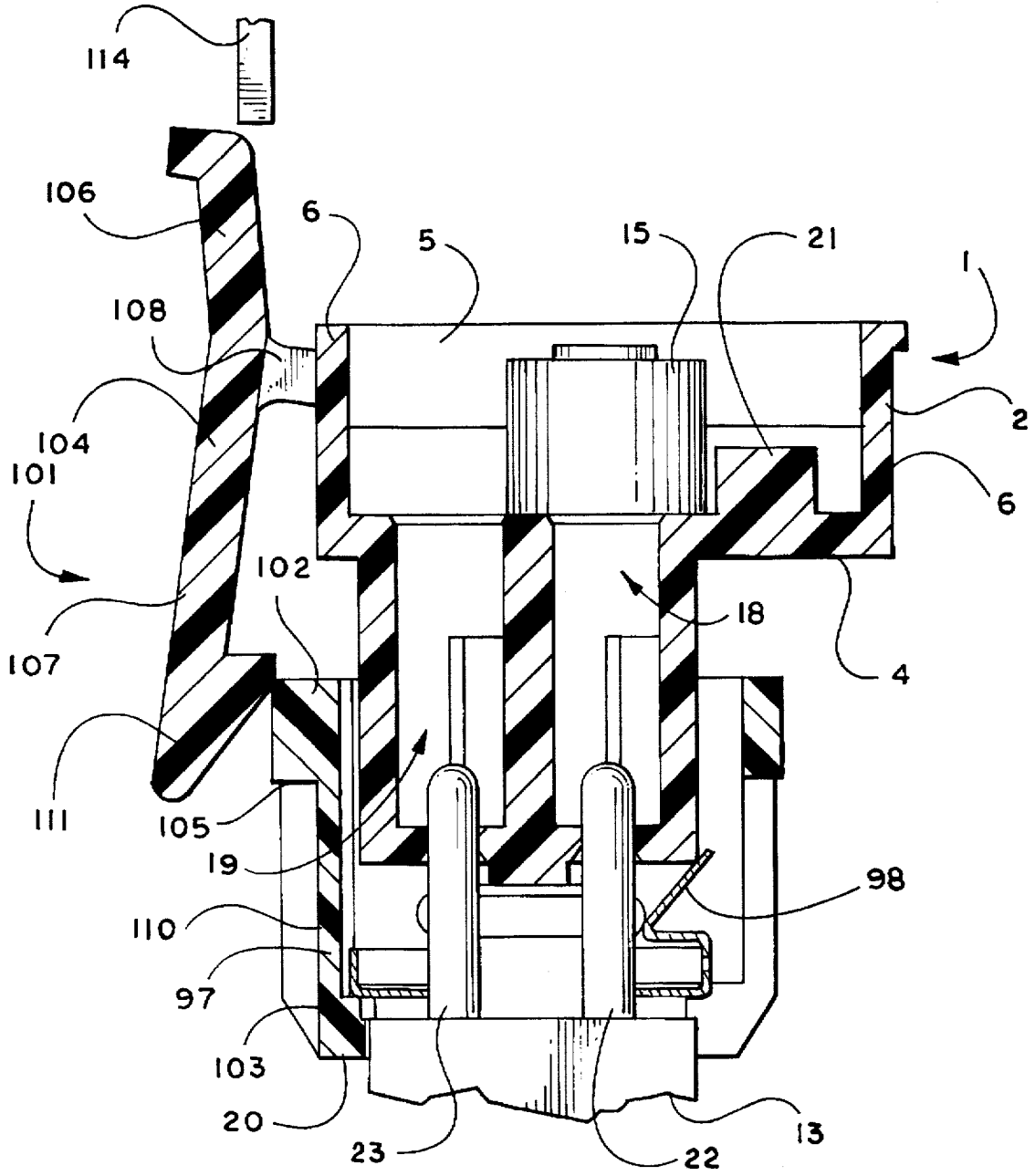
Figure 6:
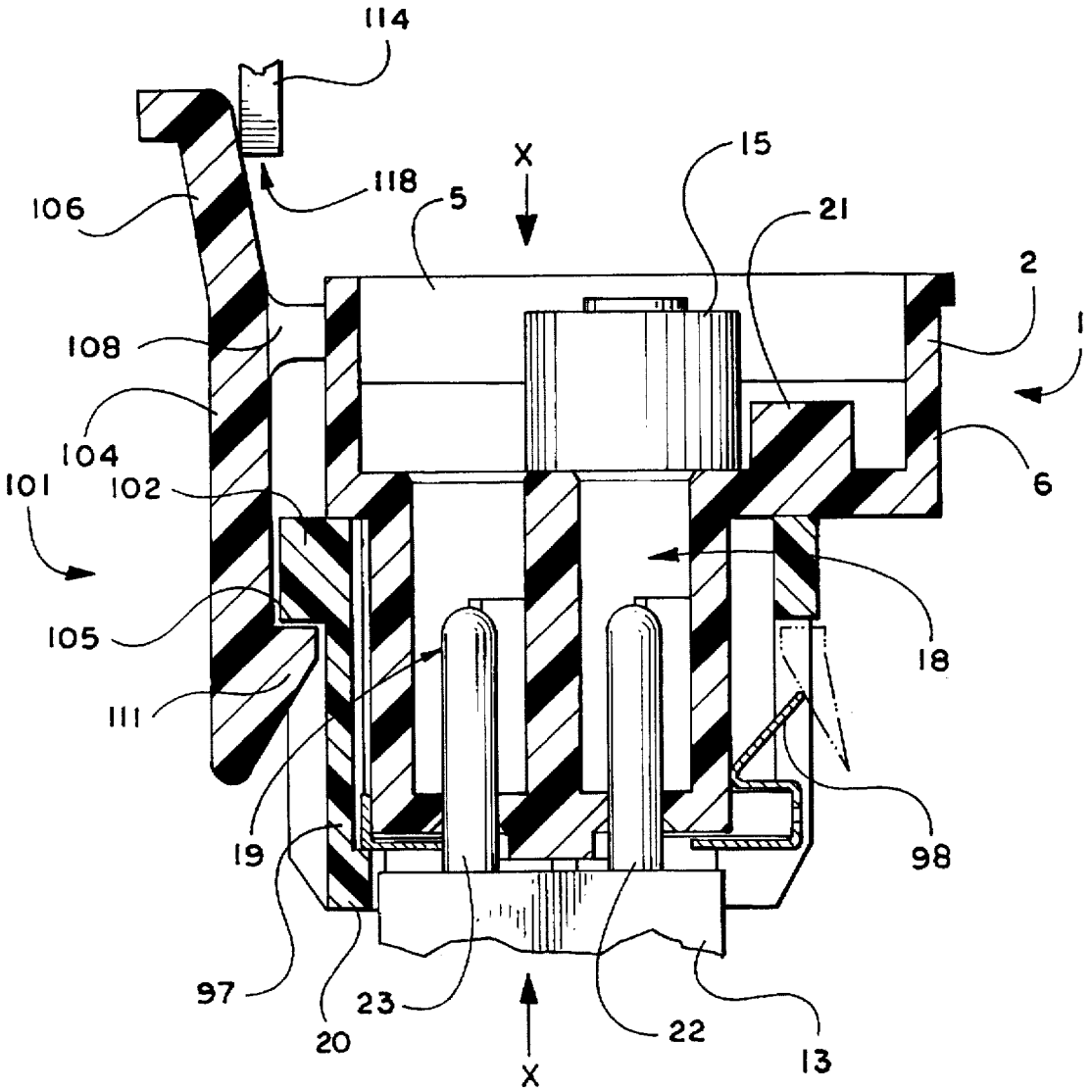

The example depicted in FIGS. 5 and 6 shows the lockable engagement device (101) according to the invention, with which the connector housing (1) for an air bag connector is locked to the air bag module housing (97), the counter-connector housing (103), if the two housings (1;103) are moved back in the direction of the arrow (X) (FIG. 6) toward one another or against the direction of the arrow (X), where after the two connector housings (1;103) are locked, the engagement device can be locked by means of the safety belt (114) of the blocking arrangement (112) (FIG. 5).

In FIGS. 8–15, the blocking arrangement (112) designed as a part of the connector housing (1) is represented without the counter-connector housing (103), in order to afford a clear representation of the blocking arrangement (112).

The guiding arrangement (113) is molded to the side wall (6) of the connector housing (1) in the region of the upper edge (96). The guiding arrangement (113) is a vertically aligned shaft (131), open at the top and bottom, with a T-shaped shaft opening in cross section, so that the shaft (131) features two narrow lateral shaft regions (132) and a central shaft region (133) jutting out from the connector housing (1). The upper rim of the shaft (131) has an inward-facing collar of the narrow lateral shaft region (132) in order to form a locking lug (134) or blocking projection (135). The locking lug (134) features an approach bevel (136) which runs diagonally downward to the inner wall of the shaft, and the blocking projection (135) is of a rectangular configuration in cross section so that it has a horizontal stop face (137) bordering the inner wall of the shaft.

The safety belt (114) is bordered at the top by a horizontal actuating plate (140) on the underside of which is provided a distance plate (141). A vertical guide spar (142) is connected to the center of the distance plate (141) and features a cross section which is adapted to the central shaft region (133) so that it can be guided in the latter in an interlocking manner. A narrow vertical locking stay (143) and a narrow vertical blocking stay (144) are arranged to be parallel to and slightly apart from the guide spar (142), where the narrow stays (141,144) are carried such that they can be shifted in the lateral shaft regions (132).

The blocking stay (144) is connected to the distance plate (141) and features a lateral locking lug (145) which juts out and has a horizontal upper blocking surface (146). The blocking lug (145) is arranged in the lower half of the blocking stay (144).

The upper-end region of the locking stay (143) features a lateral, outward-projecting, hump-shaped, locking lug (147) and its lower end is connected in a flexible manner to the guide spar (142) so that the locking lug (147) of the locking stay (143) works in connection as a locking arrangement in a flexible manner with the locking lug (134) of the shaft (131) jutting into the inner space of the shaft.

In the preblocking position (FIG. 10), the blocking surface (146) of the blocking lug (145) is supported by the stop face (137) of the blocking projection (135), so that the safety bolt (114) is prevented from being further withdrawn from the shaft (131). The locking lug (147) of the locking stay (143) is located immediately above the locking lug (134) of the shaft (131) so that the safety bolt (114) cannot slide downward in the shaft (131). The safety belt is therefore locked in the preblocking position in the shaft (131) and secured against loss.

If the safety belt (144) is pressed downward (direction of arrow Y), then the locking lug (147) of the locking stay (143) gives way in a sprung manner and goes around the locking lug (134) of the shaft (131), so that the safety bolt (114) is shifted into the shaft (131) or into the blocking position.

In the blocking position, the locking lug (134) of the locking stay (143) is locked into place immediately below the locking lug (134) of the shaft (131), so that the safety bolt (114) is prevented from being shifted upward.

The safety bolt (114) is therefore locked in beth the blocking position as well as in the preblocking position, so that both of these positions can be maintained in a defined manner.

The actuating arm (106) is preferably designed with a certain three-dimensional shape which features two lateral limiting ribs (150), which are connected in a projecting manner to the lateral grooves of the lever arm (104). The upper-end regions of the limiting ribs (150) are connected to a connecting stay (151), which features, on the side facing the side wall (6), a recess (152), engaged by the lower rim of the guide spar (142) of the safety bolt (114) in the blocking position. This three-dimensionally contoured design of the lever arm (104) with limiting ribs (150) and connecting stay (151) affords it a high degree of stiffness and functional security.

If the connector housing (1) is not correctly plugged onto the air bag module housing (97), so that the locking lug (111), rather than being locked into place behind the locking edge (105), is supported against the locking stay (102), then the actuating arm (106) is bent toward the side wall (6) of the connector housing (1) and the space of movement (118) occupied by the actuating arm (106). The safety bolt (112) can therefore no longer be moved to the blocking position; a downward movement (Arrow Y) would cause it to push against the connecting stay (151).

By means of the blocking arrangement (112) according to the invention, there is a simultaneous check, during the barring process, of whether locking has correctly occurred; if not, the safety bolt (114) cannot be moved to the blocking position.

The connector housing (1) is preferably designed with both the belt arrangement with spacers according to the invention and the locking arrangement according to the invention (FIG. 14), where the connector housing is supplied by the manufacturer to the consumer, vehicle manufacturer or air bag manufacturer, equipped with all interior elements, such as contacts, ignition coils, and the like, as a flexible belt wound into a roll. The connector housings lined up as a belt can be assembled with electrical conductors by machine at high speed in the manner indicated above, and a plug-in connection with the air bag module housing occurs by means of a simple attaching and pressing of the safety bolt (114) from the preblocking position to the blocking position, where this occurs by means of briefly pressing the large-surface actuating plate (140) of the safety bolt. The connector housing for air bag connectors according to the invention therefore permits a manipulation suitable for mass production, both for the contacting of electrical conductors as well as for being plugged together with an air bag module housing, where the high level of safety requirements placed on the components of an air bag are fulfilled.

We claim:

1. A connector housing for an air bag connector for the electrical and mechanical connecting of at least one electric line to a terminal connection (22,23), the connector housing comprising:

two housing sections (2,3) which can be plugged together and locked;

at least one contact (8,9,10) arranged in the housing to provide an electrical connection between the line and terminal connection (22,23), the contact (8,9) having an insulation-piercing contact region (24,25) for contacting an electric line;

the housing sections (2,3) having locking elements (45, 48,54,55,68) defining a pre-lock-in position which holds the housing sections (2,3) at a predetermined distance at which the line can be freely inserted and, by means of pressing together into a final lock-in position of the connector housing (1), can be contacted with the insulation-piercing contact regions (24,35);

a spacer (94,95) formed as part of one of the housing sections (2,3) and supported against the other housing section (2,3) in the pre-lock-in position to localize the one housing section supported against the other housing section, so that the connector housing is not inadvertently pressed from the pre-lock-in position to the final lock-in position;

one of the housing sections (2,3) having belt arrangements (80,81) so that several connector housings can be plugged together to form a flexible band;

one of the belt arrangements (80,81) is of a single-piece design with the spacer (94,95);

one of the housing sections having an elongated, approximately cuboid base (2) with a base wall (4), two side walls (6) and an end wall (5), where a region for acceptance of a coil (14) is located immediately behind the end wall (5); and the other housing section is a cover (3).

2. A connector housing as in claim 1, characterized in that a connector tower (7) extending downward from the base wall (4) is provided on the base (2) and has two contact cavities (18,19), open at the top and bottom, and can be plugged onto an air bag module housing (97).

3. A connector housing as in claim 2, characterized in that three contacts (8,9,10) are carried in the air bag connector (1), where the first contact (8) connects a line with a coil terminal connection (16), the second contact (10) connects an additional coil terminal connection (17) to a connector pin (23) of the primer (13) and the third contact (9) connects an additional connector pin (22) of the primer (13) to an additional line.

4. A connector housing as in claim 3, characterized in that the first contact (8) has one of the insulation-piercing contact regions (24) for the contacting of one of the lines and a crimping region (26) for the contacting of one of the coil terminal connections (16), the second contact (10) has a crimping region (32) for the contacting of another coil terminal connection (17) and a box-type plug-in jack (33) for the acceptance of one of the connector pins (23) of the primer (13), and the third contact (9) has a box-type plug-in jack (34) for the acceptance of the other connector pin (22) of the primer (13) and one of the insulation-piercing contact regions (35) for contacting of one of the lines.

5. An air bag connector as in claim 4, characterized in that the box-type plug-in jacks (24,35) are each arranged on the contacts (9,10) at a 90° offset and are carried in the contact cavities (18,19) of the connector tower.

6. An air bag connector as in claim 5, characterized in that the cover (3) has a locking spring clip (45) connected to its end wall and extending downward, which works in connection with locking lugs (45,49,50) provided on the end wall (5).

7. An air bag connector as in claim 6, characterized in that one locking lug (48) is arranged in the upper region of the end wall (5) and one or more other locking lugs (49,50) are arranged underneath the upper locking lug (45), so that the locking clip, in the pre-lock-in position, grips behind the upper locking lug (48) and, in the final lock-in position, grips behind the lower locking lugs (49,50).

8. A connector housing as in claim 7, characterized in that a locking spring arm (54) is cut free from a side wall (6) of the base (2) and a corresponding recess (63), in which is arranged an upper and lower locking lug (68,69), is provided on the cover (3), where the locking spring arm (54), in the pre-lock-in position, grips behind the lower locking lug (68) and, in the final lock-in position, grips behind the upper locking lug (69).

9. A connector housing as in claim 8, characterized in that the belt arrangements comprise a belt-locking stay (80) connected to the cover (3) and a belt-locking cavity (81) arranged diametrically opposite the belt-locking stay (80) on the cover (3), in which can be plugged, in a locking manner, a belt-locking stay (80) of an additional air bag connector (1).

10. A connector housing as in claim 9, characterized in that the belt-locking cavity (81) has a region which is open to the top, so that a belt-locking stay (80) locked within the belt- locking cavity (81) can freely swing out in order to create a flexible connection of two air bag connectors (1).

11. A connector housing as in claim 10, characterized in that the spacer is formed by means of a spacer stay (94) of single-piece construction with the belt-locking cavity (81) and extending downward and, extending inward at the lower end of the spacer stay (94), a spacer foot (95) which, in the pre-lock-in position, is supported by an upper edge (96) of one of the side walls (6) of the base (2).

12. A connector housing for an air bag connector for the electrical and mechanical connecting of at least one electric line to a terminal connection (22,23), the connector housing comprising:

two housing sections (2,3) which can be plugged together and locked;

at least one contact (8,9,10), arranged in the housing to provide an electrical connection between the line and terminal connection (22,23) the contact (8,9) having an insulation-piercing contact region (24,25) for contacting an electric line;

the housing sections (2,3) having locking elements (45, 48,54,55,68) defining a pre-lock-in position which holds the housing sections (2,3) at a predetermined distance at which the line can be freely inserted and, by means of pressing together into a final lock-in position of the connector housing (1), can be contacted with the insulation-piercing contact regions (24,35);

a spacer (94,95) formed as part of one of the housing sections (2,3) and supported against the other housing section (2,3) in the pre-lock-in position to localize the one housing section supported against the other housing section, so that the connector housing is not inadvertently pressed from the pre-lock-in position to the final lock-in position;

one of the housing sections (2,3) having belt arrangements (80,81) so that several connector housings can be plugged together to form a flexible band;

one of the belt arrangements (80,81 ) is of a single-piece design with the spacer (94,95);

a locking arrangement (101) for lockably plugging together the connector housing (1) to a counter-connector housing (103); and the locking arrangement (101 ) comprising a blocking arrangement (112;124) operative to bar a lock-in position in which the connector housing (1) is locked to the counter-connector housing (103).

13. A connector housing as in claim 12, characterized in that the locking arrangement (101) features a movable locking element which, in the lock-in position, grips behind a locking edge (105) designed as part of the counter-connector housing (103) and the blocking arrangement (112) features a safety bolt (114) which is carried in a manner permitting shifting in a guiding arrangement (113) molded as part of the connector housing (1), so that the safety bolt (114) can be moved back and forth between a preblocking position and a blocking position, where the safety bolt (114) occupies a space of movement (118) of the locking element only in the blocking position, so that the locking element is barred in the lock-in position.

14. A connector housing as in claim 12, characterized in that the safety bolt (114) can be locked in the blocking position and/or the preblocking position.

15. A connector housing as in claim 14, characterized in that the notch lever arm (104) is designed such that for an incorrect plug-in connection in which the locking lug (111) is supported on the locking stay (102), the actuating arm (106) occupies its space of movement (118) so that the safety bolt (114) cannot be moved to the blocking position.

16. A connector housing as in claim 14, characterized in that the movable locking element is a double-armed notch lever arm (104), a lever arm carrier stay (108) of which, arranged approximately at its longitudinal center and standing off at approximately a right angle, is molded as a part of a side wall (6) of the connector housing (1), so that the notch lever arm (104) forms an engagement arm (107) which extends from the lever arm carrier stay (108) in the direction of the locking edge (105) and an actuating arm (106) which extends in the opposite direction, where a locking lug (111) is molded to the free end of the engagement arm (107) in the direction of the locking edge (105), the locking edge (105) is designed to be part of a locking stay (102) projecting from a housing wall of the counter-connector housing (103), and the space of movement (118) is arranged between the actuating arm (106) and the side wall (6) of the connector housing (1).

17. A connector housing as in claim 16, characterized in that the guiding arrangement (113) is a shaft (131) with a shaft opening which is T-shaped in cross section, so that the shaft (131) features two narrow lateral shaft regions (132) and a central, shaft region (133) jutting out from the connector housing (1).

18. A connector housing as in claim 17, characterized in that the safety bolt (114) is bordered to the top by a horizontal actuating plate (140), on the underside of which is provided a distance plate (141) on which is connected a vertical guide spar (142), which features a cross section adapted to the central shaft region (133), so that it is guided in the latter in an interlocking manner, and a narrow vertical locking stay (143) and a narrow vertical blocking stay (144) are arranged parallel to and a slight distance away from the guide spar (142), so that the narrow stays (143,144) are carried in a manner which permits shifting in the lateral shaft regions (132).

19. A connector housing as in claim 18, characterized in that the upper end region of the locking stay (143) features a lateral, outward-projecting, hump-shaped, locking lug (147) and the lower end of same is connected in a flexible manner to the guide spar (142), so that the locking lug (147) of the locking stay (143) works in connection as a locking arrangement, in a sprung flexible manner, with a locking lug (134) of the shaft (131) projecting into the interior space of the shaft.

20. A connector housing as in claim 18, characterized in that the blocking stay (144) features a lateral outward-projecting blocking lug (145) with a horizontal upper blocking surface (146), where the blocking surface (146) works in connection with a stop face (137) of a blocking projection (135) projecting inward into the shaft (131) such that the blocking stay (144) is held in the shaft (131) with no chance of being lost.

21. A connector housing as in claim 19, characterized in that the blocking stay (144) features a lateral outward-projecting blocking lug (145) with a horizontal upper blocking surface (146), where the blocking surface (146) works in connection with a stop face (137) of a blocking projection (135) projecting inward into the shaft (131) such that the blocking stay (144) is held in the shaft (131) with no chance of being lost.

22. A connector housing as in claim 21, characterized in that the notch lever arm (104) is designed such that for an incorrect plug-in connection in which the locking lug (111) is supported on the locking stay (102), the actuating arm (106) occupies its space of movement (118) so that the safety bolt (114) cannot be moved to the blocking position.

23. A connector housing for an air bag connector for the electrical and mechanical connecting of at least one electric line to a terminal connection (22,23) the connector housing comprising:

two housing sections (2,3), which can be plugged together and locked;

at least one contact (8,9,10), arranged in the housing to provide an electrical connection between the line and terminal connection (22,23), the contact (8,9) having an insulation-piercing contact region (24,25) for contacting an electric line;

the housing sections (2,3) having locking elements (45, 48,54,55,68) defining a pre-lock-in position which holds the housing sections (2,3) at a predetermined distance at which the line can be freely inserted and, by means of pressing together into a final lock-in position of the connector housing (1), can be contacted with the insulation-piercing contact regions (24,35);

a spacer (94,95) formed as part of one of the housing sections (2,3) and supported against the other housing section (2,3) in the pre-lock-in position to localize the one housing section supported against the other housing section, so that the connector housing is not inadvertently pressed from the pre-lock-in position to the final lock-in position;

one of the housing sections (2,3) having belt arrangements (80,81) so that several connector housings can be plugged together to form a flexible band; and one of the belt arrangements (80,81) is of a single-piece design with the spacer (94,95) and thus is removed when the belt is cut away from the one housing section.

24. A method for the contacting of a connector housing having two housing sections which can be plugged together in a locking manner, at least one contact arranged in the housing and having an insulation-piercing contact region for contacting an electric line, the housing sections have locking elements for a pre-lock-in position which hold the housing sections apart at a predetermined distance at which the line can be freely introduced and, by means of a pressing together into a final lock-in position of the connector housing, contacted with the insulation-piercing contact regions, where the pre-lock-in position is localized by a spacer which is part of one of the housing sections so that the spacer is supported by the other housing section, where one of the housing sections is provided with belt arrangements so that several connector housings can be plugged together to form a flexible band, and where one of the belt arrangements is a single piece with the spacer, the method comprising:

cutting away at least the belt arrangement designed as a single piece with the spacer, briefly before or simultaneously with pressing together the housing sections into the final lock-in position, so that the connector housing is moved to the final lock-in position to engage the electric line without a separate step of removing the spacer.

* * * * *